United States Patent [19]

Otness

[11] 4,174,276

[45] Nov. 13, 1979

[54] HOUSEHOLD GRAIN CLEANER

[76] Inventor: Leslie Otness, R.R. 2, Box 2, Choteau, Mont. 59422

[21] Appl. No.: 917,109

[22] Filed: Jun. 19, 1978

[51] Int. Cl.[2] ..... B07B 1/04

[52] U.S. Cl. ..... 209/250; 209/259; 209/373; 209/374

[58] Field of Search ..... 209/138, 139 R, 143, 209/250, 21–23, 30, 31, 149, 259, 373, 374; 15/306 B, 306 R

[56] References Cited

U.S. PATENT DOCUMENTS

| | | | |
|---|---|---|---|
| 1,355,507 | 10/1920 | Roever | 209/250 |
| 1,512,323 | 10/1924 | Wallace | 209/143 X |
| 1,659,695 | 2/1928 | Mayhew | 209/139 R |
| 2,381,954 | 8/1945 | Hardinge | 209/144 |
| 2,789,694 | 4/1957 | Hills | 209/250 |
| 3,127,763 | 4/1964 | Lippmann | 209/143 X |

*Primary Examiner*—Ralph J. Hill
*Attorney, Agent, or Firm*—D. Paul Weaver

[57] ABSTRACT

Small batches of grain for household use are vacuum cleaned in a portable apparatus which can receive vacuum power from the hose of a household vacuum cleaner. Grain requiring cleaning is introduced into the device through a transparent top door and gravitates into a hopper within the apparatus having a restricted grain outlet. When suction is applied through the housing of the apparatus which is vented to atmosphere, air and uncleaned grain are propelled continuously on a circuitous path until the desired clean state of the grain can be observed through the transparent door, at which time another door of the device is opened to permit clean grain to pass into a holding chamber. A waste chamber is also provided in the apparatus and is separated by a screen from the main treatment chamber.

2 Claims, 2 Drawing Figures

HOUSEHOLD GRAIN CLEANER

BACKGROUND OF THE INVENTION

The increasing usage of health foods including natural grains and the popularity of the wheat grinding mill have given rise to the need for a simple and economical cleaner for small batches of wheat, barley and other small grains in the home. Such a device to be practical and to satisfy the needs of the art must be lightweight, easy to clean, requiring little or no maintenance, and must consume little energy to operate. It should be attractive in appearance and fit neatly with other canisters and the like on the housewife's kitchen counter. No known prior art device meets the needs for a household grain cleaner and the objective of the invention is to completely satisfy the need by providing a grain cleaner which is convenient to use and achieves a thorough cleaning of grains with minimum consumption of energy in a unique continuous vacuum cleaning process which utilizes the household vacuum cleaner as a source of vacuum.

The prior art contains numerous teachings pertaining to vacuum cleaning systems for grains or other granular solids but such systems and devices are constructed and used on a large commercial scale, are far too costly and complex for household use, and generally are impractical for the specific needs herein.

To comply with the duty to disclose known prior art under 37 C.F.R. 1.56, the following United States patents are made of record herein:

U.S. Pat. Nos. 1,659,659; 2,173,088; 1,850,719; 2,931,500; 2,115,107; 3,398,423.

DETAILED DESCRIPTION

Figure 1:
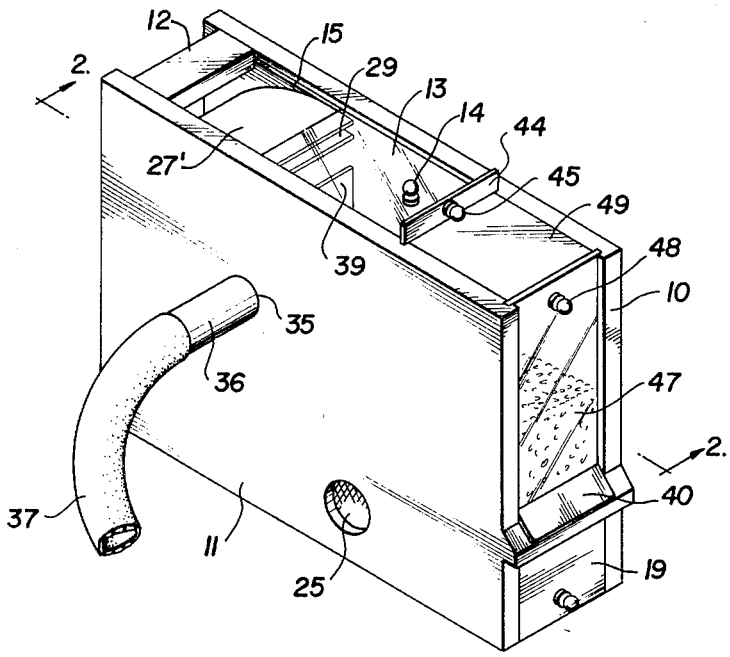
FIG. 1 is a perspective view of a household grain cleaner embodying this invention.

Referring to the drawings in detail wherein like numerals designate like parts, the grain cleaner depicted is generally rectangular and may measure approximately sixteen inches by twelve inches by five inches in a practical embodiment, although these dimensions are not limiting and may be freely varied. The cleaner includes a pair of spaced parallel side walls 10 and 11 which are rigidly connected or interbraced by one or more cross members 12. The cleaner possesses a top sliding preferably transparent door 13 having an operating knob 14 and supported and guided in grooves 15 of side walls 10 and 11.

Within the lower portion of the cleaner there is fixedly mounted a baffle 16 which spans the thickness of the device between the side walls 10 and 11. This baffle includes a lower inclined section 17 defining the bottom of a waste material collection chamber 18 having a hinged discharge door 19 which is normally closed. The baffle 16 further includes a comparatively short vertical section 20 near the center of the apparatus joined to a steeply inclined section 21 forming the lower wall of a downwardly tapering hopper chamber 22 for grain 23 requiring cleaning. The region below the baffle 16 is an air space through which the cleaner is vented to atmosphere through a side wall vent 25.

A pair of closely spaced parallel baffle plates 26 and 27 near one vertical end of the device define a relatively narrow passage 28 or slot for air and grain in the cleaning process, to be further described. These parallel baffle plates include upper integral curved extensions 26' and 27' terminating to form a top horizontal outlet slot 29 for grain and air immediately below the transparent door 13 and in vertical alignment with baffle section 20.

The lower end portion 30 of baffle plate 26 is curved, and its end forms with the baffle section 21 a restricted outlet slot 31 for grain and air leading into the passage 28. The curved baffle portion 30 diverges somewhat from a curved lower extension 22 of the baffle plate 27 so that the bottom mouth of the grain passage 28 is somewhat wider than the remainder of the passage 28 to create a larger area for the entry of grain and to eliminate back flow of air into the hopper. A further horizontal plate extension 33 on the curved portion 32 extends into the space at the bottom of the device. The inclined baffle section 21 has its lower edge extending approximately one-half way between the curved elements 30 and 32 to form a restriction at 31' in order to increase the velocity of air at this point entering the mouth of passage 28 and into which air stream grain is being entrained at the bottom outlet of the hopper chamber 22. The vertical baffle plate 26 and inclined baffle section 21 form the hopper chamber 22 which extends between the side walls 10 and 11, as do all the baffle components of the device.

The region above the hopper chamber 22 and below the arcuate baffle plate portion 26' and the top door 13 forms a main suction chamber in which the necessry degree of vacuum is created through a side wall port 35 adapted for coupling with a nozzle 36 of a conventional household canister vacuum cleaner hose 37. A C-baffle 38 surrounds the vacuum port 35 in the chamber 34 and is mounted for swiveling around its axis for adjustment so that no grain and only light particles of debris are drawn into the vacuum hose 37 through the mouth of the C-baffle 38. In other words, the position of this mouth in the chamber 34 can be adjusted by swiveling or rotating the C-baffle 38. A further vertical baffle 39 above the fixed baffle section 20 partially defines the main vacuum chamber 34. In some instances, the baffle 39 can be made adjustable relative to the baffle plate 26 to regulate the width of the chamber 34 and the strength of the vacuum created therein.

The top of debris chamber 18 is defined by an inclined plate 40 having a vertical extension 41 rising therefrom. A taut inclined screen 42 is secured to the top of the extension 41 and the top of baffle section 21 and separates the chamber 18 from the vacuum chamber 34 in the device. A restricted passage 43 between the C-baffle 38 and inclined baffle section 21 is formed through which air and grain circulate during the cleaning process, as indicated by the arrows.

A vertical sliding door 44 having an operating knob 45 is provided immediately above the extension 41 and bottoming thereon when the door 44 is closed. When closed, the door 44 separates the upper portion of the vacuum chamber below the horizontal door 13 from a clean grain storage chamber 46 above the debris chamber 18 and equipped with a vertically sliding clean grain outlet door 47 having a knob 48. The top of chamber 46 is closed by a fixed top wall portion 49 extending between the side walls 10 and 11 and rigidly connected thereto. In some instances, instead of the sliding door 44 at the mouth of clean grain storage chamber 46, a swinging door may be used as a variant of the invention.

It should be noted that the grain cleaner can be constructed from various materials, such as wood and sheet metal, or from various plastics materials. In commercial production, a low cost model can be constructed from plastics while a more deluxe model having fine wood components for the side walls and other parts can also be produced.

OPERATION

Figure 2:
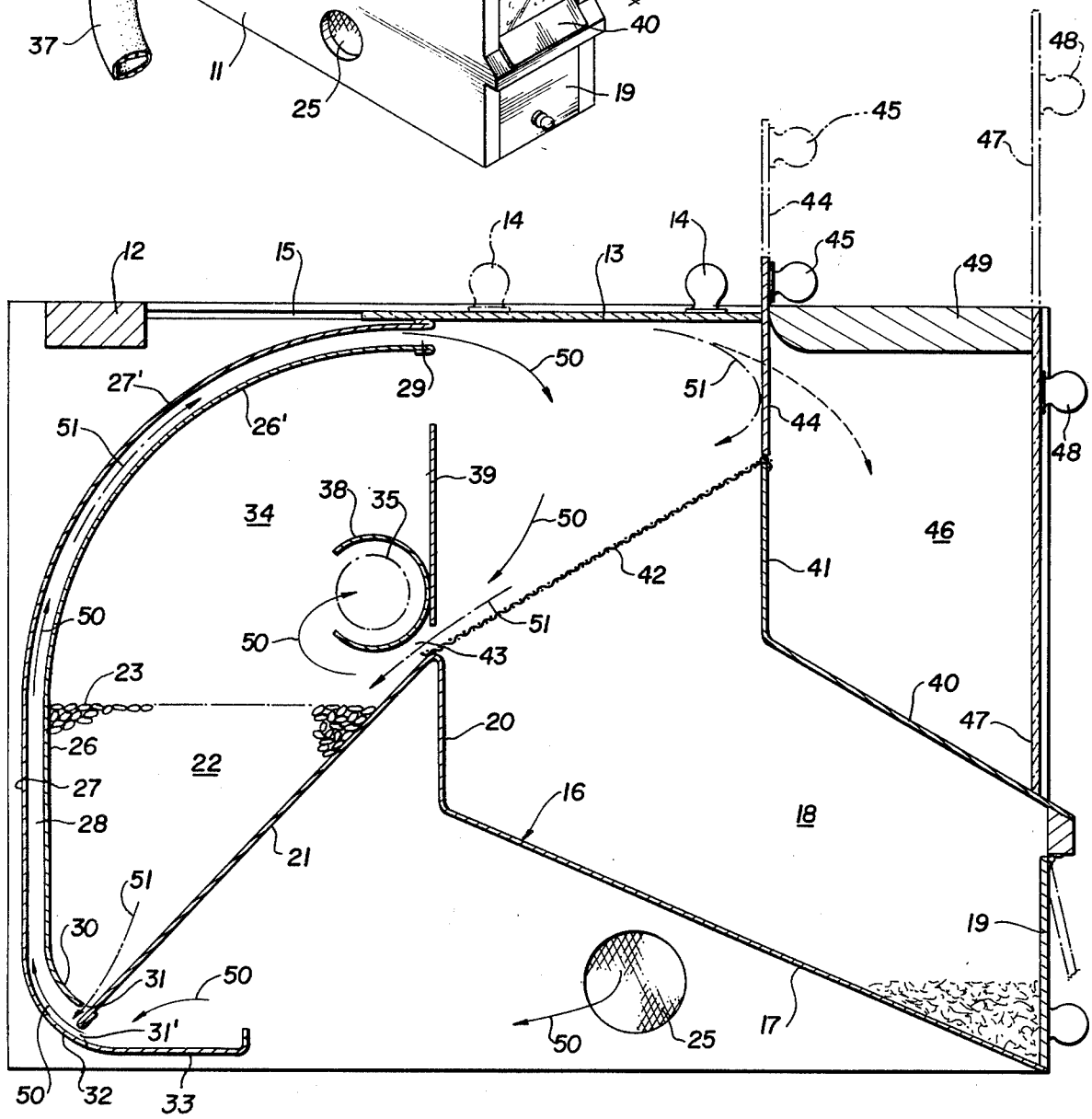
FIG. 2 is an enlarged vertical cross section through the cleaner taken on line 2—2 of FIG. 1.

The door 13 is opened and a small batch of uncleaned wheat or other grain 23 is dumped into the space above the screen 42 and will gravitate into the hopper chamber 22 as shown in FIG. 2. The door 13 is then closed as is the door 44 and the other doors 19 and 47 and the vacuum cleaner is turned on to create a partial vacuum in the device.

This vacuum draws air in through the vent 25 and such air flows in the direction of the solid arrows 50 on the circuitous path shown in FIG. 2. The air is continuously being sucked out of the vacuum port 35 and into the hose 37. The circuitous air path includes the narrow passage 28, the upper portion of the chamber 34 beyond the outlet slot 29 and the restricted passage 43 leading to the hopper chamber. The suction stream is strong enough to draw uncleaned grain 23 through the outlet slot 31 and such grain is entrained in the continuously circulating suction air stream as indicated by the broken arrows 51. This circulation of air and entrained grain continues until the grain is sufficiently cleaned for use and the cleaning process can be observed at all times through the transparent door 13 at the top of the device. During the continuous vacuum cleaning process, air and light debris of a powdered nature pass out through the vacuum cleaner hose 37. Other waste material of a heavier type will fall through the screen 42 and collect in the chamber 18. The entrained grain will continuously rebound off of the vertical door 44 which aids in the cleaning process. A kind of Venturi action is created where air enters the bottom of the narrow passage 28 and grain from the hopper chamber 22 passes through the slot 31 to be entrained in the high velocity suction air stream. The resulting cleaning action is thorough and quite rapid.

When the grain is sufficiently clean, the vertical door 44 is opened and the clean grain exiting from the outlet or slot 29 at relatively high velocity will enter the clean grain holding chamber 46 and in very little time all of the grain will enter this chamber and the vacuum cleaner can be shut off. The door 47 can then be opened to collect the clean grain, and the door 19 can be opened to remove debris from the chamber 18.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A household grain cleaner comprising a pair of spaced upright side walls, baffle means extending between said side walls and defining therewith a primary vacuum chamber in the upper portion of the grain cleaner near one end thereof and a downwardly tapering grain hopper below the primary vacuum chamber in open communication therewith, one of said side walls having a vacuum port formed therein communicating directly with said primary vacuum chamber and adapted for coupling with a hose of a household vacuum cleaner, said baffle means further defining with said side walls a bottom chamber in said cleaner and below said grain hopper having a vent to ambient atmosphere, a debris storage chamber above said bottom chamber at the end of the cleaner away from said hopper and a clean grain collection chamber above said debris chamber and at the last-named end of said cleaner, separately operable closure panels for said debris and said clean grain collection chambers on the cleaner at the last-named end thereof, and another closure panel at the top of said cleaner between the clean grain collection chamber and said primary vacuum chamber, the primary vacuum chamber extending beyond one side of said hopper at the top of the hopper and toward said clean grain collection chamber and across the mouth of said debris storage chamber, a screen panel extending between said side walls at the mouth of said debris storage chamber and defining the bottom of the portion of said primary vacuum chamber which is extended beyond said hopper, another closure panel at the top of said cleaner and operable to allow the introduction of grain to be cleaned into the primary vacuum chamber and hopper, an upright baffle extending between said side walls in said primary vacuum chamber and at the side of the hopper nearest to said debris collection chamber and screen and defining therewith a restricted passage for grain entering said hopper, said screen panel being inclined to direct grain downwardly toward said restricted passage, the bottom of said hopper having a restricted outlet across the hopper and between said side walls, and another baffle extending between said side walls and cooperating with said baffle means to define a narrow elongated grain passage at said one end of the cleaner extending from the restricted outlet of the hopper upwardly at said one end to an exit point substantially at the top of the cleaner and at the top of said primary vacuum chamber and substantially above said upright baffle, whereby grain undergoing cleaning can flow in a circuitous path from the restricted outlet of the hopper through said narrow passage, into said primary vacuum chamber and then through the restricted passage near the top of the hopper defined by said upright baffle and screen panel.

2. A household grain cleaner as defined in claim 1, and a lip extension on one wall of said hopper at the bottom thereof and projecting somewhat below the restricted outlet of the hopper and partially across the mouth of said narrow passage to form another restricted passage between the lower end of said narrow passage and said bottom chamber of the cleaner.

* * * * *